US009230729B2

(12) United States Patent
Kubota et al.

(10) Patent No.: US 9,230,729 B2
(45) Date of Patent: Jan. 5, 2016

(54) TRANSFORMER, AMORPHOUS TRANSFORMER AND METHOD OF MANUFACTURING THE TRANSFORMER

(71) Applicant: Hitachi Industrial Equipment Systems Co., Ltd., Tokyo (JP)

(72) Inventors: Keisuke Kubota, Tainai (JP); Yoetsu Shiina, Tainai (JP); Toshiki Shirahata, Shibata (JP); Jyunnji Ono, Shibata (JP); Takaaki Hasegawa, Tainai (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/643,821

(22) Filed: Mar. 10, 2015

(65) Prior Publication Data

US 2015/0187489 A1 Jul. 2, 2015

Related U.S. Application Data

(62) Division of application No. 13/369,968, filed on Feb. 9, 2012, now Pat. No. 9,000,877.

(30) Foreign Application Priority Data

Feb. 16, 2011 (JP) ..... 2011-030366
Jun. 24, 2011 (JP) ..... 2011-140091

(51) Int. Cl.
*H01F 27/24* (2006.01)
*H01F 27/30* (2006.01)
(Continued)

(52) U.S. Cl.
CPC ..... *H01F 27/306* (2013.01); *H01F 3/04* (2013.01); *H01F 27/24* (2013.01); *H01F 27/2455* (2013.01); *H01F 41/0226* (2013.01); *Y10T 29/49071* (2015.01)

(58) Field of Classification Search
CPC ..... H01F 27/00–27/35
USPC ..... 336/65, 83, 198, 212–215, 220–223, 336/233–234
See application file for complete search history.

(56) References Cited

U.S. PATENT DOCUMENTS 4,970,776 A 11/1990 Yamamoto et al.
5,055,815 A 10/1991 Yamamoto et al.
(Continued)

FOREIGN PATENT DOCUMENTS

DE 20 2010 004 898 U 8/2010
JP 62-238612 A 10/1987
(Continued)

OTHER PUBLICATIONS

Notice of Allowance U.S. Appl. No. 13/369,968 dated Dec. 4, 2014.
(Continued)

*Primary Examiner* — Tuyen Nguyen
(74) *Attorney, Agent, or Firm* — McDermott Will & Emery LLP

(57) ABSTRACT

A transformer wherein the upper portions of cores are supported by a first supporting member disposed on first end surfaces of the upper portions of the cores, and a second supporting member disposed on second end surfaces of the upper portions of the cores, the first and second supporting members extend in the direction perpendicular to the faces of a magnetic material, and the cores are interposed between the first upper core supporting member and the second upper core supporting member; the first and second upper core supporting members are provided with hooks, the hooks of the first supporting member extending toward the second supporting member and the hooks of the second supporting member extending toward the first supporting member; bridging members are disposed on the opposing pairs of the hooks of the first and second upper core supporting members; and the cores are supported by the bridging members.

9 Claims, 7 Drawing Sheets

(51) Int. Cl.

| | |
|---|---|
| ***H01F 3/04*** | (2006.01) |
| ***H01F 41/02*** | (2006.01) |
| ***H01F 27/245*** | (2006.01) |

(56) References Cited

U.S. PATENT DOCUMENTS

| | | | | |
|---|---|---|---|---|
| 5,307,044 | A | 4/1994 | Watabe | |
| 5,892,420 | A | 4/1999 | Larranaga et al. | |
| 6,005,468 | A * | 12/1999 | Shirahata | H01F 27/306 336/210 |
| 6,411,188 | B1 * | 6/2002 | Pruess | H01F 1/153 29/602.1 |
| 6,750,749 | B2 * | 6/2004 | Shirahata | H01F 30/12 336/198 |
| 8,552,830 | B2 * | 10/2013 | Mikoshiba | H01F 27/25 336/210 |
| 9,105,393 | B2 * | 8/2015 | Takahashi | H01F 27/306 1/1 |
| 2002/0057180 | A1 | 5/2002 | SHIRAHATA et al. | |
| 2004/0137247 | A1 | 7/2004 | Ono et al. | |

FOREIGN PATENT DOCUMENTS

| | | | |
|---|---|---|---|
| JP | 62-199919 | U | 12/1987 |
| JP | 2-7446 | Y2 | 2/1990 |
| JP | 06-163281 | A | 6/1994 |
| JP | 8-1329 | U | 8/1996 |
| JP | 10-172837 | A | 6/1998 |
| JP | 10-189348 | | 7/1998 |
| JP | 2000-082625 | A | 3/2000 |
| JP | 2001-160513 | A | 6/2001 |
| JP | 2006-120879 | | 5/2006 |

OTHER PUBLICATIONS

Japanese Office Action issued in Japanese Patent Application No. 2011-140091 dated Apr. 8, 2014.

Japanese Office Action issued in corresponding Japanese Application No. 2011-030366 dated Jul. 14, 2014 with English translation.

Final Office Action U.S. Appl. No. 13/369,968 dated Jul. 18, 2014.

Non-Final Office Action U.S. Appl. No. 13/369,968 dated Sep. 9, 2013.

Non-Final Office Action U.S. Appl. No. 13/369,968 dated May 16, 2013.

* cited by examiner

TRANSFORMER, AMORPHOUS TRANSFORMER AND METHOD OF MANUFACTURING THE TRANSFORMER

CROSS REFERENCE TO RELATED APPLICATION

This application is a Divisional application of U.S. Ser. No. 13/369,968 dated Feb. 9, 2012, which claims priority from Japanese Patent applications JP2011-030366 filed on Feb. 16, 2011 and JP2011-140091 filed on Jun. 24, 2011. The subject matter of each is incorporated herein by reference in entirety.

BACKGROUND OF THE INVENTION

The present invention relates to a technique for fabricating a transformer that has cores composed of lamination of thin magnetic material.

The present invention also relates to a transformer having amorphous-iron cores.

An amorphous-iron core transformer is disclosed in, for example, JP-A-2006-120879. In this Japanese patent document, the technical advantage is stated as follows. Since the amorphous-iron cores themselves stand upright without being supported by any supporting mechanism, the weights of the cores do not exerted on the windings, and lapping work does not depend on the shapes of finished windings so that lapping process can be stabilized. As a result, the characteristics of the cores and the workability of the process of insulating the cores from the coils can be both improved.

The transformer according to the Japanese patent document has its windings subjected to molding process using varnish impregnation in order to secure the resistance to short-circuit in the large-sized windings resulting from the demand for large power handling.

According to conventional methods of manufacturing transformers having amorphous-iron cores, when the windings and the amorphous-iron cores are assembled, the windings are kept upright and the amorphous-iron cores are inserted from above through the windings in the vertical direction, and then the assembly of the windings and the cores is laid down to lap the cores.

JP-A-10-189348 discloses a technique according to which both the lengthwise ends of the coil bobbin protrude beyond both the lengthwise ends of each winding when the turns of the winding have been wound around the coil bobbin so that when the amorphous-iron core is inserted through the winding, the insertion of the core through the winding can be facilitated and that the core can be prevented from damaging the inner side surface of the winding.

SUMMARY OF THE INVENTION

According to, for example, current methods of manufacturing amorphous-iron core transformers, the windings are laid down; the amorphous-iron cores are inserted through the windings; the cores are lapped; all necessary attachments are put on; and the whole assembly is raised upright.

In case of a large-sized transformer for handling large power, the overall weight of the windings becomes very heavy, and when the assembly of the windings and the cores is laid down, the overall weight of the cores and the windings acts on those parts of the outer surfaces of the windings which are in contact with any supporting surface. As a result, there is a possibility that the insulating material for the windings may be damaged. Hence, some countermeasures should be devised to eliminate such a drawback inherent to conventional methods.

As the weight of the amorphous-iron cores increases with the increase in the capacity of the transformer, the conventional method which makes it inevitable to cause the weight of the amorphous-iron cores to act on the lengthwise ends of the windings after the cores have been raised upright, cannot be free from the possibility that the weight acting on the windings may damage the insulating material for the windings as described above. Hence, some countermeasures should be devised to eliminate such a drawback inherent to conventional methods.

The damage to the insulating material will lead to the deterioration in the mechanical strength and the reliability of the windings. Therefore, it is necessary to consider how unnecessary load can be prevented from acting on the windings when the amorphous-iron cores and the windings are assembled to build an amorphous-iron core transformer of large power handling capacity. This is a subject matter in which this invention should be involved.

JP-A-10-189348 discloses the method of manufacturing an amorphous-iron core transformer, according to which the insertion of the amorphous-iron cores through the windings is facilitated and the possibility is alleviated that the inside surfaces of the windings may be damaged. However, JP-A-10-189348 does not describe the influence of the weight of the amorphous-iron cores on the windings.

For example, if the windings which are finished through a process of immobilizing the turns of the windings, are treated by the current manufacturing method as described above, the total weight of the windings and the amorphous-iron cores acts on the outer surfaces of the windings that are in contact with any supporting surface when the assembly of the windings and the amorphous-iron cores is laid down. Accordingly, consideration must be given to the mechanical strength and the insulation reliability of the windings.

It, therefore, is necessary to devise a structure for an amorphous-iron core transformer according to which when the windings finished through immobilizing the turns thereof and the amorphous-iron cores are assembled, the influence of the weight of the amorphous-iron cores on the windings is alleviated. It is also necessary to consider a method for assembling or manufacturing such an amorphous-iron core transformer as mentioned just above. This is another subject matter of this invention.

The object of this invention is to provide methods, which are improved as compared with conventional methods, for assembling and manufacturing transformers having amorphous-iron cores, and to develop such structures for transformers as are well adapted to applications of the methods.

According to this invention, which has been made to attain the object described above, a method is employed in which a transformer having cores composed of laminas of magnetic material is assembled while the cores and the windings are kept in their upright positions. The transformers manufactured according to this method can enjoy advantages over transformers manufactured according to conventional methods.

The object of this invention described above will now be rephrased as follows.

There is provided a transformer including annular cores composed of laminas of magnetic material and windings, wherein in order to assemble the cores and the windings while the cores are being kept upright, upper portions of the cores are supported by a first upper core supporting member disposed on first end surfaces of the upper portions of the cores, the first end surfaces being perpendicular to the faces of the laminas, and a second upper core supporting member disposed on second end surfaces of the upper portions of the cores, the second end surfaces being opposite and parallel to the first end surfaces of the cores;

lower portions of the cores are supported by a first lower core supporting member disposed on first end surfaces of the lower portions of the core, the first end surfaces being perpendicular to the faces of the laminas, and a second lower core supporting member disposed on second end surfaces of the lower portions of the cores, the second end surfaces being opposite and parallel to the first end surfaces of the cores;

first insulation members are disposed on and between the first lower core supporting member and the second lower core supporting member;

the windings are disposed on the first insulation members;

second insulation members are disposed on top of the windings;

the first upper core supporting member and the second upper core supporting member are provided with hooks, the hooks of the first upper core supporting member extending toward the second upper core supporting member and the hooks of the second upper core supporting member extending toward the first upper core supporting member, and opposing pairs of the hooks of the first and second upper core supporting members being located respectively on the second insulation members;

bridging members are disposed on the opposing pairs of the hooks of the first and second upper core supporting members;

lower portions of the annular cores are open;

the cores are inserted through the windings from above while the cores and the windings are being kept upright;

the inserted cores are supported by the bridging members; and the lower portions of the core are closed after insertion so as to restore the annular cores.

In order to solve a problem inherent to the structure of a conventional large-sized transformer, the ends of a firm bobbin is protruded from the lengthwise ends of each winding in a transformer having amorphous-iron cores, according to this invention.

Further details of embodiments of the present invention will be described below.

In an amorphous-iron core transformer having windings wound on bobbins and amorphous-iron cores inserted through the bobbins, the bobbins have protrusions extending beyond the lengthwise ends of the windings.

Further, protrusions are provided for that part of the bobbin which bears the weight of the amorphous-iron core when the assembly of the winding and the amorphous-iron core is laid down.

Moreover, the dimension of the protrusion are diminished on the inner surface of the bent portion of the amorphous-iron core so that the protrusion may not interfere with the inner surface of the bent portion of the amorphous-iron core.

Furthermore, that part of the protrusion which lies on the inner surface of the bent portion of the amorphous-iron core is cut away so that the protrusion may not interfere with the inner surface of the bent portion of the amorphous-iron core.

It should be noted that the present invention can be applied to any transformers other than the amorphous-iron core transformer and to a method of manufacturing such transformers.

According to this invention, there can be provided a transformer that has a higher reliability than any one of conventional transformers and a method of manufacturing such a highly reliable transformer.

Further, according to this invention, an amorphous-iron core transformer can be provided which has a higher reliability than any other conventional amorphous-iron core transformer.

Other objects, features and advantages of the invention will become apparent from the following description of the embodiments of the invention taken in conjunction with the accompanying drawings.

DESCRIPTION OF THE EMBODIMENTS

Embodiments of this invention will be described in reference to the attached drawings.

Figure 1:
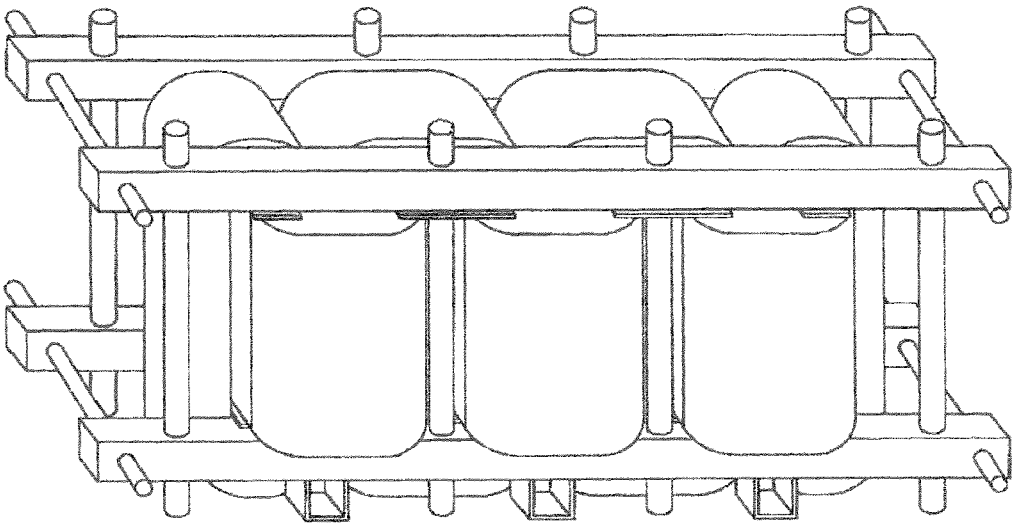
FIG. 1 shows the internal components of a transformer as an embodiment of this invention in its assembled state.
Figure 2:
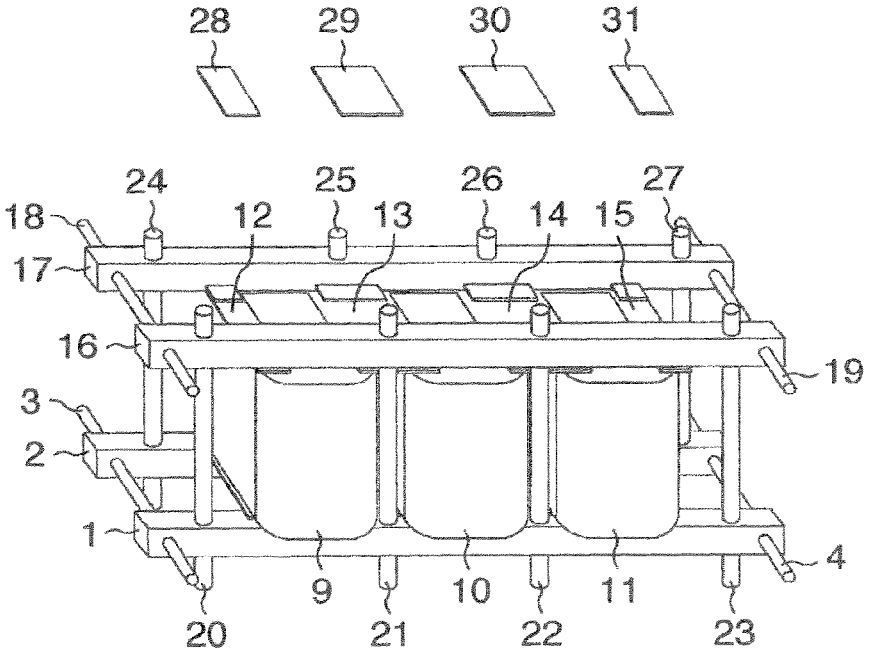
FIG. 2 shows the internal components of a transformer as an embodiment of this invention, as seen before the cores of amorphous iron has been inserted in place.

FIG. 1 illustrates a transformer as an embodiment of this invention, in its assembled state;

FIG. 2 illustrates the structure of the windings of the transformer shown in FIG. 1, as seen before the cores of amorphous iron has been inserted in place.

Figure 3:
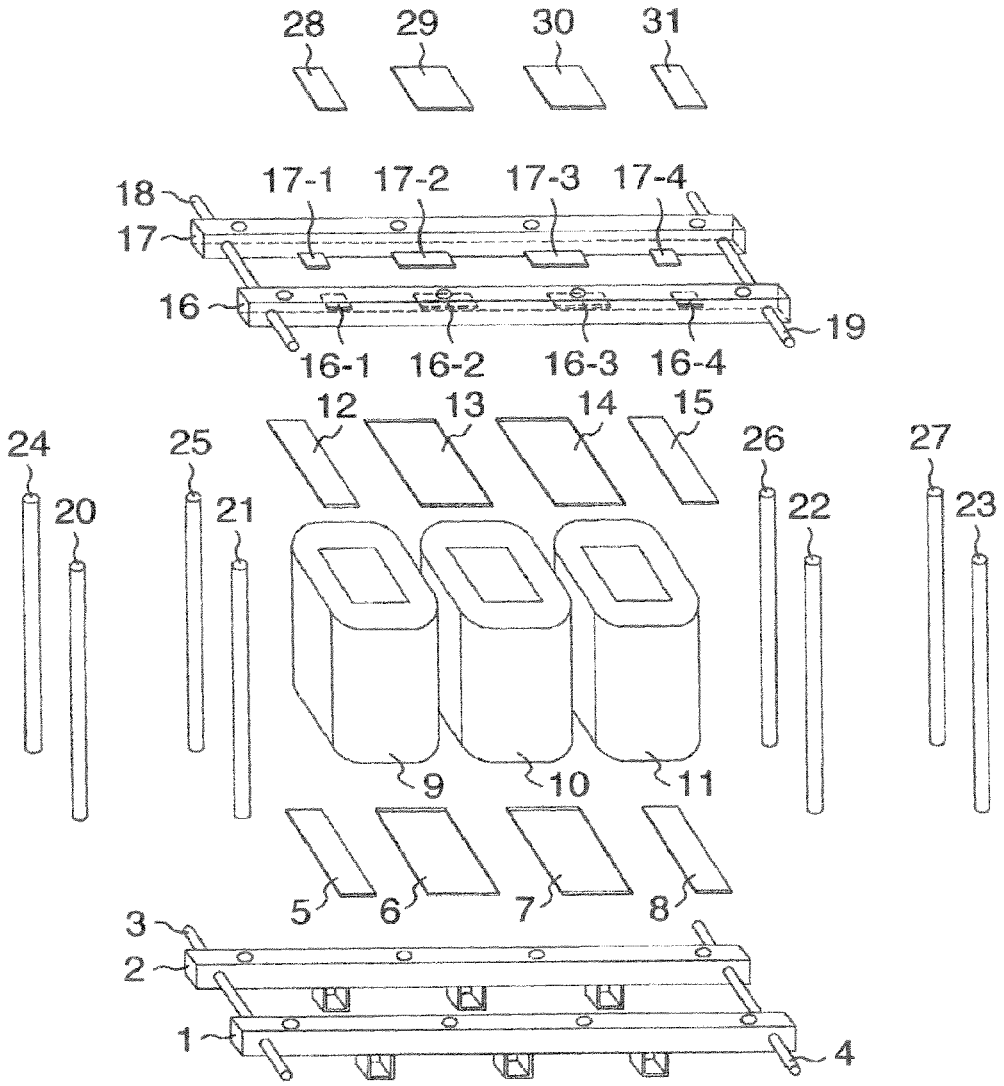
FIG. 3 is an exploded view of the internal components of a transformer as an embodiment of this invention.

FIG. 3 is an exploded view of the structure shown in FIG. 2.

As shown in FIG. 3, the transformer according to an embodiment of this invention comprises: two lower core clampers 1,2 (i.e. a first lower core supporting member and a second lower core supporting member); two studs 3, 4 (i.e. immobilizing members) for immobilizing the two lower core clampers 1, 2; lower insulation walls 5, 6, 7, 8 (i.e. first insulation members); windings 9, 10, 11; upper insulation walls 12, 13, 14, 15 (i.e. second insulation members); two upper core clampers 16, 17 (i.e. a first upper core supporting member and a second upper core supporting member); two studs (i.e. immobilizing members) 18, 19 for immobilizing the two upper core clampers 16, 17; studs 20, 21, 22, 23, 24, 25, 26, 27 (i.e. immobilizing members) for immobilizing the lower and upper core dampers 1, 2, 16, 17; and insulation plates 28, 29, 30, 31 (i.e. second insulation members).

Now, the method of manufacturing the transformer according to this embodiment will be described below.

First, the two core dampers 1, 2 are disposed opposite and in parallel to each other. Then, let the studs 3, 4 pass through the two core clampers 1, 2, and the studs 3,4 are screwed up with nuts so as to fix the positions of the two core clampers 1, 2.

The insulation walls 5, 6, 7, 8 are put on the two fixed core clampers 1, 2, to provide electric insulation between the windings 9, 10, 11 and the two core clampers 1, 2. The windings 9, 10, 11 are placed upright on the insulation walls 5, 6, 7, 8.

The upper insulation walls 12, 13, 14, 15 are disposed on the upper ends of the windings 9, 10, 11 to electrically insulate between the windings 9, 10, 11 and the upper core clampers 16, 17. The two upper core clampers 16, 17 are placed opposite and in parallel to each other, on the upper insulation walls 12, 13, 14, 15.

The upper core clampers 16, 17 are provided respectively with hooks 16-1, 16-2, 16-3, 16-4, 17-1, 17-2, 17-3, 17-4 which are disposed just over or corresponding to the upper insulation walls 12, 13, 14, 15.

The hooks are welded to the upper core clampers in this embodiment, but the way of attaching the hooks to the dampers is not limited to welding. The hooks may be attached to the clampers by inserting or fitting the hooks into the holes or slits made in the core clampers.

It is needless to say that not only holes and slits but also any other mechanism that allows the hooks and the core clampers to be engaged with each other can be employed.

Further, additional members may be used to fix the hooks to the core clampers. For example, screws, bolt-and-nuts, or adhesive agents may be used to fix the hooks to the core clampers.

Moreover, hooks may be formed as an integral parts of core clampers in the process of manufacturing core clampers. For example, hooks may be formed by cutting, forging or rolling raw material into clampers.

The hooks and the upper insulation walls are separated by space from each other to prevent the contact thereof. The upper core dampers are so disposed with respect to each other in assembly that the hooks of one clamper are opposed to the hooks of the other.

The studs 18, 19 are inserted through the upper core clampers 16, 17, and the upper core clampers 16, 17 are fixed in place by means of nuts.

Further, the studs 20, 21, 22, 23, 24, 25, 26, 27 are inserted through the upper core clampers 16, 17 and the lower core clampers 1, 2, and the core clampers 1, 2, 16, 17 are fixed in place by means of nuts. The windings 9, 10, 11 are fixed in place by means of the upper and lower core clampers and the studs.

Now, let the insulation plates 28, 29, 30, 31 bridge the hooks 16-1, 16-2, 16-3, 16-4 of the upper core damper 16 and the hooks 17-1, 17-2, 17-3, 17-4 of the upper core damper 17, respectively.

Figure 4:
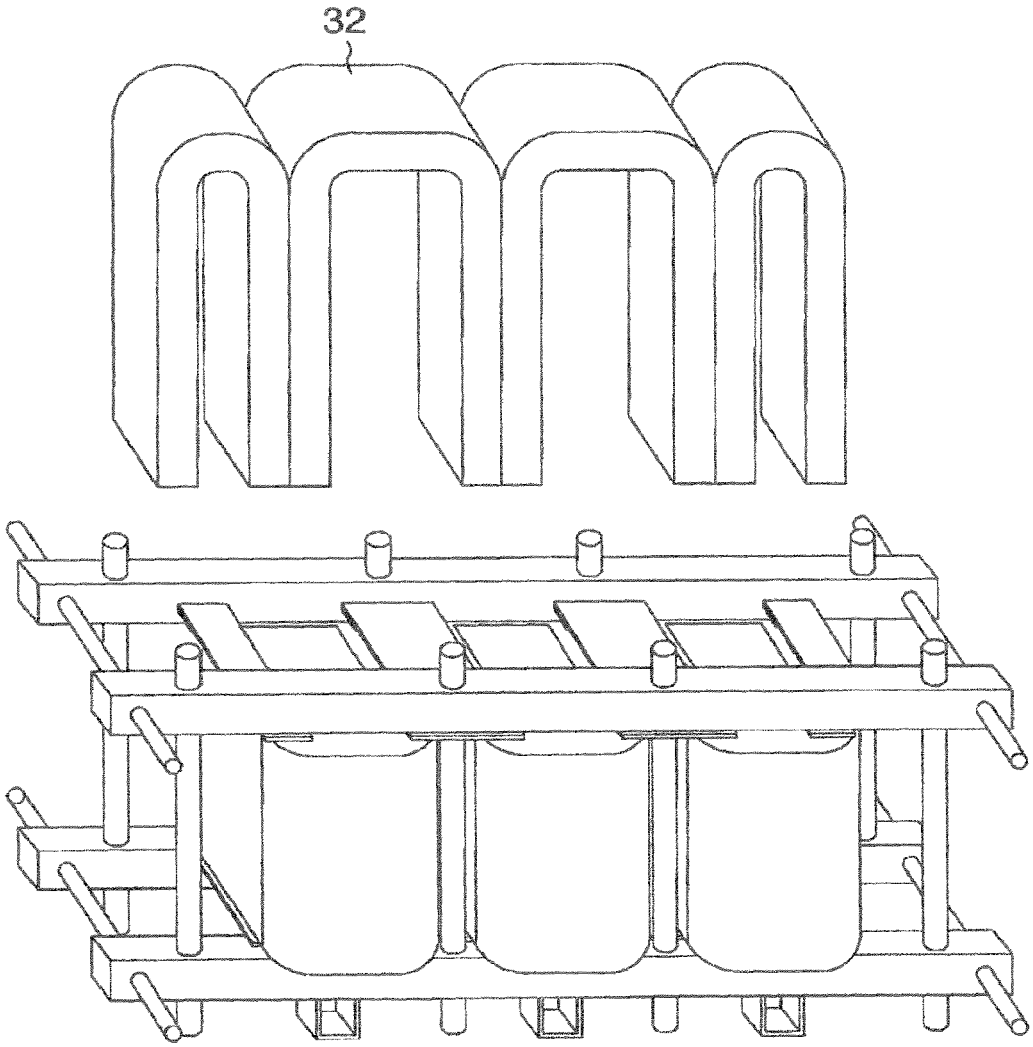
FIG. 4 illustrates how amorphous-iron cores are inserted through the central openings of the windings or the bobbins on which the windings are wound.

Then, as shown in FIG. 4, amorphous-iron cores 32 are inserted through the central openings of the windings 9, 10, 11 or the bobbins on which the windings are wound.

In this case, the amorphous-iron cores 32 are arranged to be supported by the insulation plates 28, 29, 30, 31.

Subsequently, as shown in FIG. 4, each open end of the U-shaped core 32 is closed by a matching piece of amorphous iron, and thus lapping is performed thereafter. After lapping, each of the amorphous-iron cores takes an annular shape.

As described above, according to this embodiment, each annular amorphous-iron core is cut into two parts of which one is a U-shaped portion and the other is a matching portion. The U-shaped portions are inverted and inserted into the openings of the windings from above while the windings are being positioned upright.

When inserted into the openings of the windings, the amorphous-iron cores are supported by the insulation plates that bridge the hooks of the upper core clampers so that the weight of the amorphous-iron cores can be prevented from being exerted directly on the windings. Thus, the windings can be protected from being damaged and the mechanical, physical and electric characteristics of the windings can also be prevented from deteriorating.

Further, in the manufacturing process, since the amorphous-iron cores and the windings are assembled in their upright positions, the resulting transformer is finished without the amorphous-iron cores and the windings recumbent horizontally (this position is different by 90 degrees from the upright position).

Consequently, machines, tools, facilities or a system for laying down the amorphous-iron cores and the windings can be dispensed with, and also procedures for operating the machines, tools, facilities or system can be eliminated. This leads to an improvement in the efficiency of work.

Moreover, it can be expected that the possibility of the amorphous-iron cores and the windings degrading in mechanical, physical and electrical characteristics due to unexpected force, load or gravity exerted on the amorphous-iron cores and the windings when they are laid down, is diminished.

In the above described embodiment, the given description was that the lower part of the annular amorphous-iron core is cut open to divide it into two pieces; a U-shaped portion and a matching portion. The reason is as follows. In general, when an amorphous-iron core is annealed, it takes an annular shape. Before it is put into a winding, it must be cut open at its lower part to result in a U-shaped portion shown in FIG. 4 and its matching portion. The U-shaped portion is inserted through the winding and then the matching portion is put back to the U-shaped portion to restore the original annual shape. This series of steps are called the lapping procedure.

Note here, however, that according to this invention, the amorphous-iron core need not be necessarily annealed in an annular shape. For example, if it is annealed in a U-shape different from an annular shape, the step of an annular core being cut open is not necessary. In this case, after the U-shaped core has been inserted through the winding, an additional amorphous-iron piece is attached to the open end of the U-shaped core to complete an annular shape.

In the foregoing description, the given explanation was that the open end of the U-shaped core is closed by the attached piece to complete the annular shape. It should be noted here that the term "annular shape" includes but is not limited to physically annular shapes.

The "annular core" according to this invention includes cores having any shapes through which magnetic flux can circulate to form a closed circuit. For example, even if an iron core is not physically annular with one or more gaps therein, the iron core is said to be annular if the magnetic flux through it forms a closed circuit.

The above description of the embodiments concern the upright position of windings. The term "upright position" is meant to denote a condition that something laid down has been put upright.

That is, the upright position of windings means a state that the windings stand in upright position.

In the embodiment described above, the "upright position" denote the state in which the iron core is put in the vertical or plumb position.

Depending on the shape of iron core or the measuring method, it often happens that the measured direction of the axis of the iron core is not exactly coincident with the vertical or plumb direction.

However, even if the axial direction is not identical with the vertical or plumb direction, it does not matter. The "upright position" is again meant to be a state that something which was laid down has been raised.

Some features resulting from the upright position are considered to be quoted as follows.

If the iron core is put horizontal or laid down, the winding through which the iron core is inserted is also put horizontal or laid down. In such a case, that part of the winding which is on the lower side of the iron core receives the influence of the gravity by the iron core in the vertical or plumb direction.

In the case of a large transformer, the weight of the iron core is also large; the physical influence on the part of the winding which is in contact with the lower side of the iron core by the weight of the iron core becomes considerable; and it is necessary to devise a technique for mitigating the influence of weight.

On the other hand, if the transformer is assembled after its iron cores have been put upright, that is, they have been raised from their laid-down positions, then the influence of the weight of the iron cores or the transformer itself on those parts of the windings which are in contact with the lower sides of the iron cores can be greatly lessened. In other words, since the windings do not lie beneath the iron cores, it hardly happens that the weight of the iron cores or the transformer itself is exerted on the windings.

Consequently, the physical influence of the weight of the iron cores on the windings is lessened so that the degradation of the electrical characteristics of the windings can be prevented.

In the foregoing description, the vertical or plumb direction is often mentioned. The "plumb" direction is the direction of a string which has its one end fixed and the other end suspending a plumb, that is, the direction of gravity that is defined as the direction perpendicular to the horizontal plane at the position of interest.

According to the embodiment described above, the windings are not laid down, and therefore the weight of the windings and the amorphous-iron cores is prevented from being exerted on the resin-coated surfaces of the windings. The mechanical strength and the reliability of insulation of the windings can be improved as compared with those of the windings manufactured according to conventional methods.

Further, with the use of hooks that prevent the weight of the amorphous-iron cores from being exerted on the top side of the windings, the mechanical strength and the reliability of insulation of the windings can be improved as compared with those of the windings manufactured according to conventional methods.

According to conventional methods, the procedure of manufacturing a transformer includes the steps of laying down, assembling and putting upright. On the other hand, according to the manufacturing method disclosed in this invention, the transformer can be manufactured with its iron cores and windings set upright. Accordingly, the manufacturing procedure is simpler according to this invention than according to the conventional techniques.

Note that the above described embodiment can be applied to the manufacture of a transformer having the windings that are finished with insulation process.

Also, note that the manufacturing procedure of this embodiment is not so much affected by the shapes and sizes of the individual windings.

Now, a second embodiment of this invention will be described below with reference to the attached drawings.

In the figures referred to below, a three-dimensional rectangular coordinate system including x-axis, y-axis and z-axis is introduced to facilitate the understanding of the geometrical relationship among the positions of components.

Figure 6:
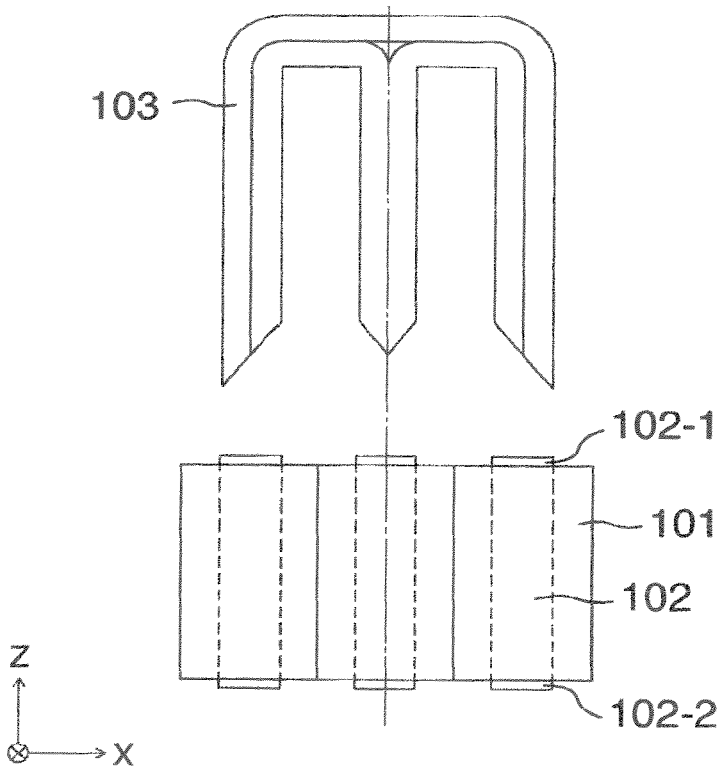
FIG. 6 illustrates another example of how amorphous-iron cores are inserted through the central openings of the windings or the bobbins on which the windings are wound.

As shown in FIG. 6, the z-axis indicates the lengthwise direction of amorphous-iron cores 103, and the amorphous-iron cores 103 are inserted through the windings 101 in upright position in the assembling process in this direction.

As shown also in FIG. 6, the x-axis indicates the direction in which the windings are juxtaposed to one another.

Further, as shown in FIG. 6, the y-axis indicates the direction that is perpendicular to the xz-plane defined by the x-axis and the z-axis and also to the sheet of FIG. 6. The surfaces of the laminas constituting the amorphous-iron cores are parallel to the yz-plane defined by the y-axis and the z-axis.

Figure 5:
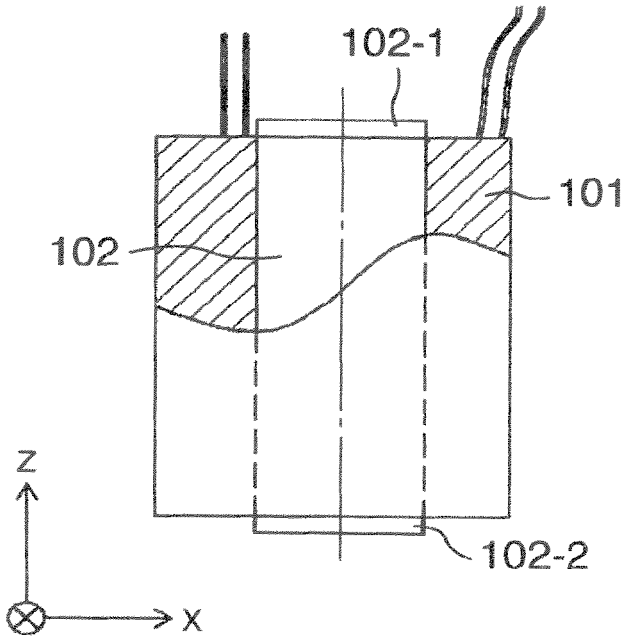
FIG. 5 shows a winding and a (coil) bobbin according to an embodiment of the invention.

FIG. 5 shows a winding and a (coil) bobbin according to this embodiment of the invention. As shown in FIG. 5, the winding 101 is wound around the bobbin 102, and the cross section of the winding perpendicular to the y-axis is denoted by hatching.

Before starting the description of the second embodiment, the procedure of assembling an amorphous-iron core transformer according to this embodiment will be briefly explained below with reference to the attached drawings.

It is presupposed that the z-axis indicates the direction of a string suspending a plumb, i.e. direction of gravity or plumb direction, or the direction perpendicular to the horizontal plane.

In FIG. 6, windings 101 and amorphous-iron cores 103 are in their raised or upright positions, and the amorphous-iron cores 103 are inserted through the windings 101 by moving the amorphous-iron cores 103 from above to below in the direction of the z-axis.

Figure 7:
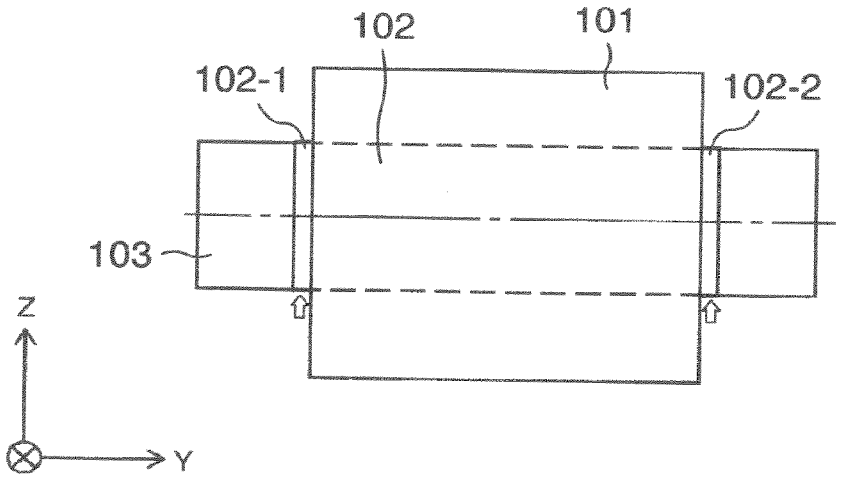
FIG. 7 shows the state where the winding with the amorphous-iron core inserted through it is recumbent.

Then, the windings 101 with the amorphous-iron cores 103 inserted through them are laid down as shown in FIG. 7. With the windings 101 laid down in the horizontal direction, the amorphous-iron cores 103 are subjected to lapping process.

In FIG. 7, too, the z-axis is in the plumb direction, and as the coordinate value along the z-axis increases, the altitude increases.

Figure 8A:
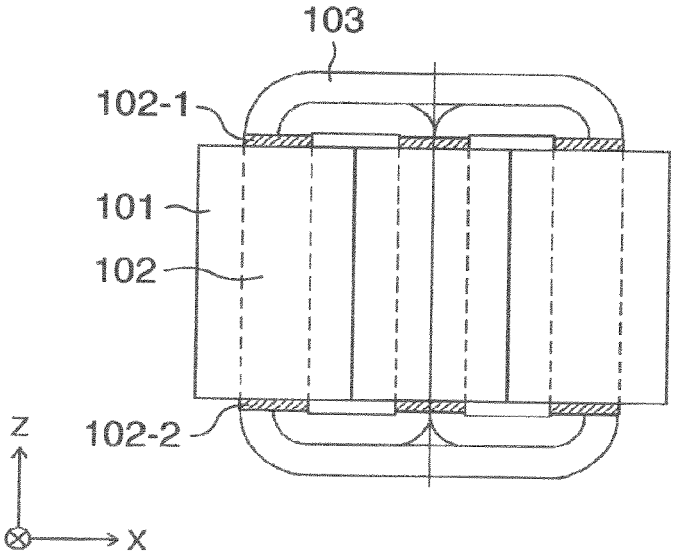
FIGS. 8A and 8B show the assembly of the lapped amorphous-iron cores and the windings which is raised up and set in the upright position.
Figure 8B:
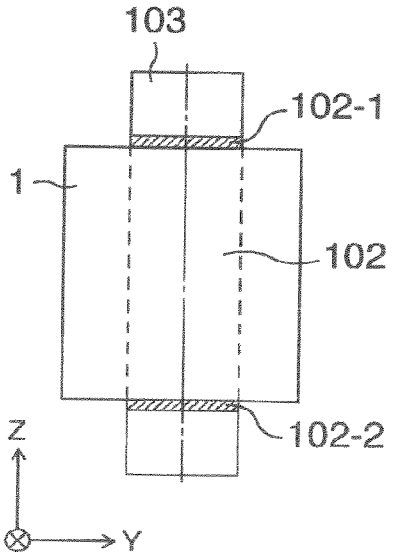

Thereafter, the assembly of the lapped amorphous-iron cores 103 and the windings 101 are raised up and set in the upright position as shown in FIG. 8A and FIG. 8B. FIG. 8A is a front view of the core-winding assembly and FIG. 8B is a side view of the same assembly.

Now, the second embodiment of this invention will be described in reference to FIG. 5.

As shown in FIG. 5, the bobbin 102 inside the winding 101 extends slightly longer than the lengthwise dimension of the winding 101 in the z-axis direction so that protrusions 102-1, 102-2 are provided.

It is to be noted here that the bobbin 102 should be made of iron or a insulating material which has a sufficient strength to withstand the total weight of the winding 101 and the amorphous-iron core 103. If the material is metal, the bobbin should not completely wrap around the amorphous-iron core 103, that is, should not form a full turn.

A lead or conductor wire is wound around the bobbin 102 to form a coil; the coil is then impregnated with varnish to immobilize the turns of the winding; the winding 101 is raised up and set in the upright position as shown in FIG. 6; the amorphous-iron core 103 is inserted from above through the bobbin 102; and the assembly of the winding 101 and the amorphous-iron core 103 is laid down.

When the assembly is laid down, it is supported at the protrusions 102-1, 102-2 of the bobbin 102 by a supporting mechanism as shown in FIG. 7 so that no load is applied to the outer surface of the winding 101.

To be more concrete, the assembly of the winding 101 and the amorphous-iron core 103 is laid down by rotating it about the x-axis in FIG. 6. In other words, it is important that the assembly should not be laid down by rotating it about the y-axis in FIG. 6.

The amorphous-iron core 103 is lapped while the assembly of the winding 101 and the amorphous-iron core 103 is recumbent as shown in FIG. 7.

Now, the meaning of the statement "The assembly is laid down in such a manner that no load is applied to the outer surface of the winding 101." will be explained below.

In FIG. 7, the negative direction of the z-axis is the direction in which the gravity acts on matters. Accordingly, the amorphous-iron core 103 is pulled in the negative direction of the z-axis in accordance with its mass. This pulling force then acts on the winding or the varnish-impregnated turns of the winding. Therefore, some countermeasure must be devised to secure the mechanical strength of the winding or the varnish-impregnated turns of the winding.

However, as shown with the embodiment in FIG. 5, the protrusions 102-1, 102-2 can support the weight of the amorphous-iron core so that the load on the winding or the varnish-impregnated turns of the winding can be accordingly lessened.

In FIG. 7, two bold, outlined arrows (pointing up) indicate the locations at which the weight of the amorphous-iron core is supported by the protrusions 102-1, 102-2.

Consequently, even when the assembly of the amorphous-iron cores 103 and the windings 101 is rotated and laid down to lap the amorphous-iron cores, the influence of the weight of the amorphous-iron cores 103 on the windings or the varnish-impregnated turns of the windings can be alleviated.

A third embodiment of this invention will be described in reference to FIGS. 9, 10A and 10B.

Figure 9:
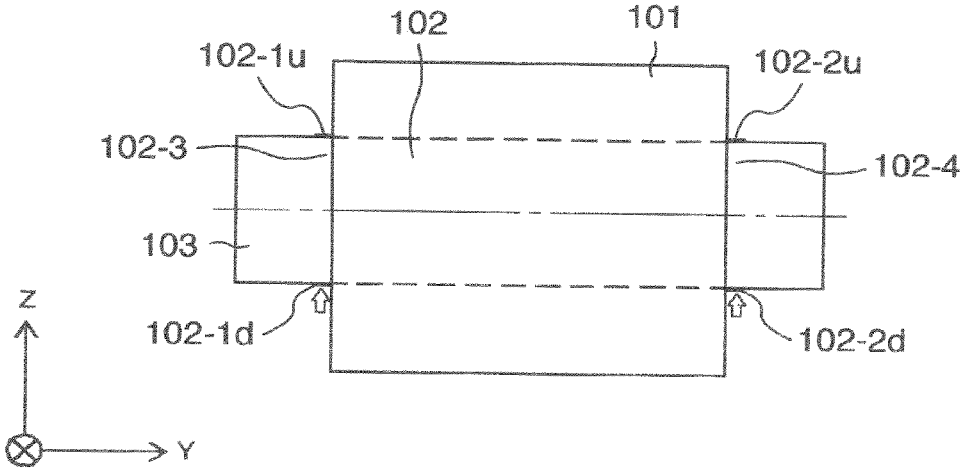
FIG. 9 shows the assembly of the lapped amorphous-iron cores and the windings which is recumbent.
Figure 10A:
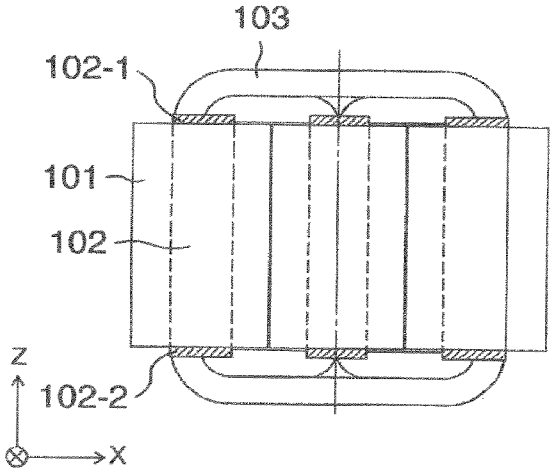
FIGS. 10A and 10B show another example of the assembly of the lapped amorphous-iron cores and the windings which is raised up and set in the upright position.
Figure 10B:
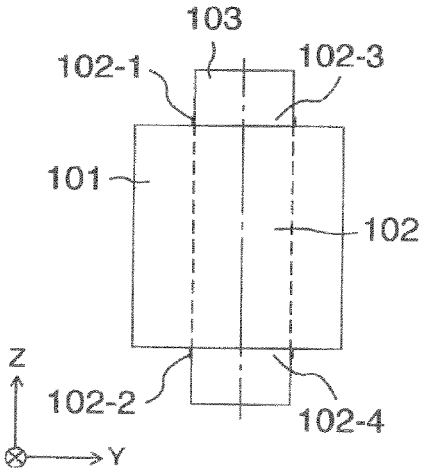
Figure 11:
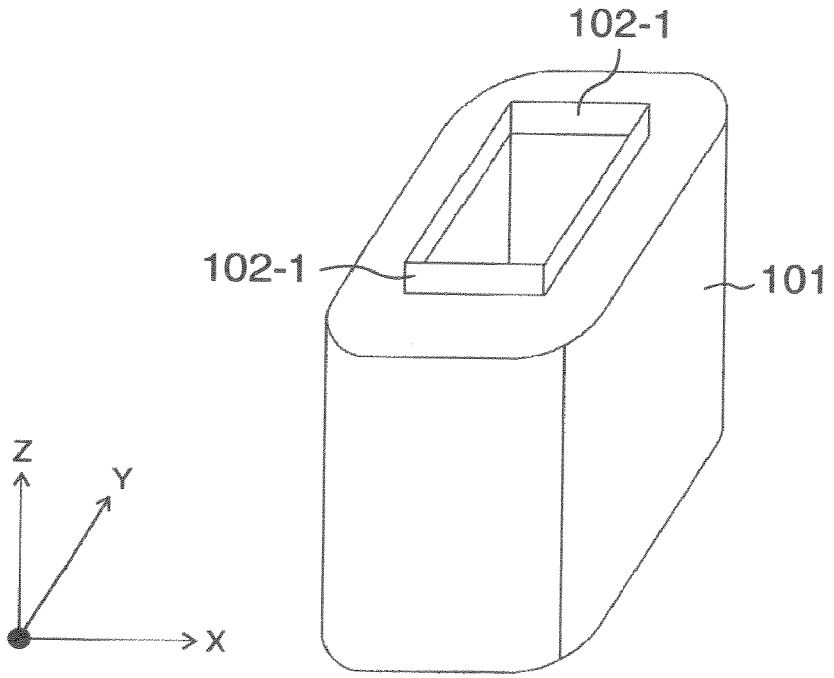
FIG. 11 shows in perspective view a winding and its bobbin according to an embodiment of this invention.
Figure 12:
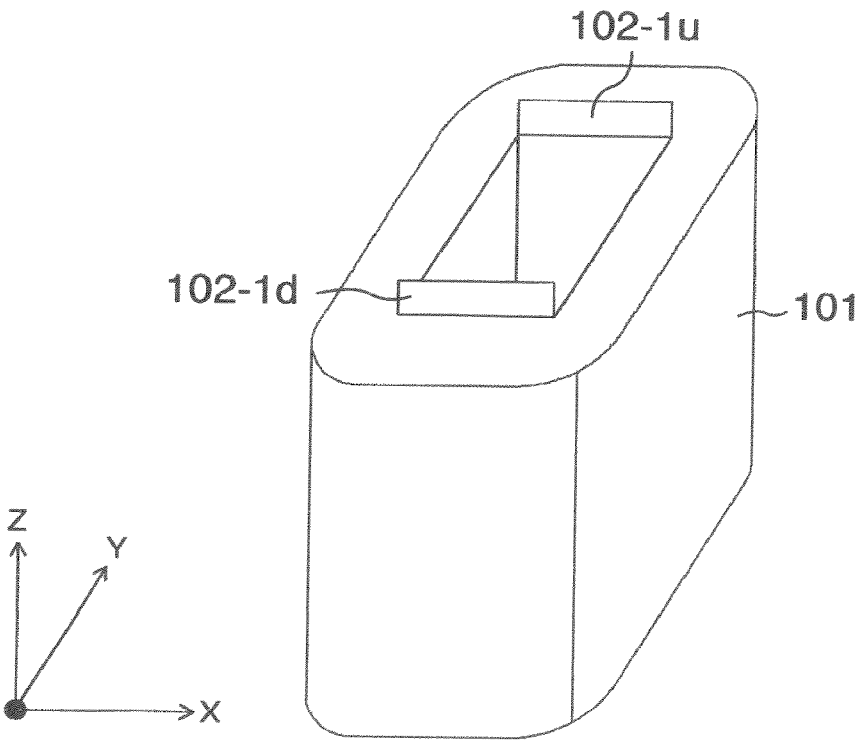
FIG. 12 shows in perspective view a winding and its bobbin according to another embodiment of this invention.

In FIG. 9, just as shown in FIG. 5 and FIG. 7, the bobbin has protrusions. However, these protrusions do not encircle the core, but the bobbin lacks protrusions on the faces of the core that are parallel to the yz-plane. FIG. 12 shows this situation in a perspective view. FIG. 11 shows in perspective view the protrusions 102-1, 102-2 (not shown in FIG. 11 as it is hidden behind the winding 101) that encircle the core as shown in FIGS. 5 and 7.

The winding 101 is wound on the bobbin 102, and the amorphous-iron cores 103 is inserted therein as shown in FIG. 9. Thereafter, the assembly of the lapped amorphous-iron cores 103 and the windings 101 are raised up and set in the upright position as shown in FIG. 10. The difference between configurations of the embodiment shown in FIG. 10 and the embodiment shown in FIG. 8A is as follows. FIG. 8B shows the protrusions 102-1 and 102-2. On the other hand, in the embodiment of FIG. 10, the protrusions do not encircle the core, but the bobbin lacks protrusions on the faces of the core that are parallel to the yz-plane. FIG. 10B does not show the protrusions 102-1 and 102-2 on the surface parallel with Y-axis.

In the case of the bobbin having the protrusions 102-1, 102-2 (not shown in FIG. 11 as it is hidden behind the winding 101) as shown in FIG. 11, that part of the protrusion 102-1 which extends in the direction of the y-axis makes it necessary to increase the length of the amorphous-iron core 103 in the direction of the z-axis so that the bent portion of the core 103 may not interfere with or contact the part of the protrusion 102-1 extending in the direction of the y-axis.

In other words, if the dimension of the bobbin 102 in the direction of the z-axis exceeds the dimension of the winding in the direction of the z-axis, that is, if the bobbin 102 is provided with the protrusions 102-1, 102-2 fully encircling the core, then the dimension of the amorphous-iron core 103 in the direction of the z-axis must be increased accordingly. This leads to an increase in the mass of amorphous iron to be used.

The above embodiment can solve this problem. As shown in FIG. 9, those parts of each of the protrusions 102-1, 102-2 which are parallel to the yz-plane are cut away so that the dimensions in the direction of the y-axis of those surfaces of the bobbin 102 which are parallel to the yz-plane, becomes equal to the dimension of the winding in the direction of the y-axis.

With this structure of the bobbin 102 having those parts of each of the protrusions 102-1, 102-2 which are parallel to the yz-plane, cut away, the dimension of the amorphous-iron core in the direction of its height can be prevented from being increased. It should be noted that according to this invention, the lengthwise dimension of that part of the bobbin 102 which does not have protrusions on both ends, need not be necessarily equal to the lengthwise dimension of the winding 103, but can be varied within a certain range of values so far as the degree of contact between the bent portions of the amorphous-iron core and the lengthwise ends of the winding is small or so far as the influence of the weight of the amorphous-iron core on the lengthwise ends of the winding is small.

Alternatively, when the above embodiment is rephrased, it is said that those parts of the protrusions which might otherwise be in contact with the inner surfaces of the bent portions of the cores, are not provided.

Further, when the assembly of the amorphous-iron core 103 and the winding 101 is rotated around the x-axis in FIG. 6 and laid down as shown in FIG. 9, the negative direction of the z-axis in FIG. 9 is the direction of the gravity and the bobbin 102 has protrusions 102-1*d*, 102-2*d*, 102-1*u*, 102-2*u* formed as the extensions of its surfaces parallel to the xy-plane, the protrusions 102-1*d*, 102-2*d* bearing the weight of the amorphous-iron core 103.

In FIG. 9, protrusions 102-1*u*, 102-2*d* are shown, for example. As shown in FIG. 9, the gravity pulls the amorphous-iron core 103 in the negative direction of the z-axis. Accordingly, in order to prevent the weight of the core 103 from being exerted on the winding 101, those surfaces of the bobbin 102 which are parallel to the xy-plane are provided with the protrusions 102-1*u*, 102-2*d*.

Moreover, in FIG. 9, the surfaces of the bobbin 102 parallel to the yz-plane need not bear the weight of the amorphous-iron core 103, and therefore those surfaces are not provided with protrusions, or alternatively those parts of protrusions parallel to the yz-plane are cut away. The bobbin shown in FIG. 11 has no part of the protrusion cut away, and therefore leads to the simplification of structure. On the other hand, the bobbin shown in FIG. 12 has parts of its protrusions cut away, and therefore although the structure becomes a little more complex, the mass of material for the core can be prevented from increasing.

It is once more mentioned that those protrusions 102-1*u*, 102-2*u* located in the upper positions as viewed in the positive direction of the z-axis in FIG. 9, which are not indicated by outlined arrows pointing up in FIG. 9 and which are not labeled as 102-1*u*, 102-2*u* in FIG. 7, need not be necessarily provided, and that an embodiment having a bobbin with this design of protrusions is possible.

In such a case, however, it should be noted that when the assembly of the amorphous-iron core 103 and the winding 101 is rotated about the x-axis and laid down from its upright position as shown in FIG. 6, it must be rotated and laid down in such a manner that the protrusions indicated by the outlined arrows pointing up in FIGS. 7 and 9, which are the protrusions 102-1*u*, 102-2*u* in FIG. 9 and which are not labeled as 102-1*u*, 102-2*u* in FIG. 7, come to the bottom side with respect to the positive direction of the z-axis.

In the above description, it was said that the surfaces of the bobbin 102 parallel to the yz-plane need not bear the weight of the amorphous-iron core 103. This means that when the upright assembly of the amorphous-iron core 103 and the winding 101 is laid down as shown in FIG. 7 or FIG. 9, the assembly is rotated and laid down while those portions of the bobbin 102 which are protruding from the upper and lower ends of the winding 101 and which are the protrusions 102-1*d*, 102-2*d*, are supported by a supporting mechanism, so that the weight of the amorphous-iron core 103 can be prevented from being exerted on those surface of the winding 101.

Accordingly, when the assembly of the amorphous-iron core 103 and the winding 101 is laid down, attention should be paid so that the influence of the weight of the amorphous-iron core 103 on the winding 101 can be alleviated. Thus, the way a transformer according to an embodiment of this invention is assembled and manufactured is also a feature of the embodiment.

According to the embodiments described above, when the assembly of the amorphous-iron core and the winding which is finished with, for example, varnish impregnation for immobilizing its turn conductor, is laid down, the influence of the weight of the amorphous-iron core on the winding is smaller than on conventional comparable windings. Consequently, the mechanical strength and the insulation reliability of the winding according to this invention can be said to have been improved as compared with those of conventional windings.

According to the present invention, the structure of the windings is scalable to any shapes of the winding such as round types or rectangular types.

According to the present invention, even though the sizes of products of the windings are uneven, the height of bobbins are made to be similar so that the face alignment between adjacent windings can be easily made as compared with the prior art.

Furthermore, according to the present invention, even though the sizes of products of the windings are uneven irrelevantly to whether the cut-away is exist or not, the height of bobbins are made to be similar so that the face alignment with another windings can be easily made as compared with the prior art.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A transformer including annular iron cores composed of laminas of magnetic material and windings, wherein upper portions of the cores are supported by a first upper core supporting member disposed on first end surfaces of the upper portions of the cores, the first end surfaces being perpendicular to faces of the laminas, and a second upper core supporting member disposed on second end surfaces of the upper portions of the cores, the second end surfaces being opposite and parallel to the first end surfaces of the cores;

the first upper core supporting member and the second upper core supporting member extend in the direction perpendicular to the faces of the laminas of magnetic material, and the cores are interposed between the first upper core supporting member and the second upper core supporting member;

the first upper core supporting member and the second upper core supporting member are provided with hooks, the hooks of the first upper core supporting member extending toward the second upper core supporting member and the hooks of the second upper core supporting member extending toward the first upper core supporting member;

bridging members are disposed on opposing pairs of the hooks of the first and second upper core supporting members; and the cores are supported by the bridging members.

2. The transformer according to claim 1, wherein the bridging members are made of insulating material.

3. The transformer according to claim 1, wherein a first lower core supporting member is disposed on first end surfaces of lower portions of the cores, the first end surfaces being perpendicular to the faces of the laminas, and a second lower core supporting member is disposed on second end surfaces of the lower portions of the cores, the second end surfaces being opposite and parallel to the first end surfaces of the cores; and the lower portions of the cores are supported by the first lower core supporting member and the second lower core supporting member.

4. The transformer according to claim 3, wherein first insulation members are disposed between the first and second lower core supporting members and the windings.

5. The transformer according to claim 4, wherein the first insulation members are located in the positions corresponding to the opposing pairs of the hooks of the first and second upper core supporting members.

6. The transformer according to claim 1, wherein second insulation members are disposed between the opposing pairs of the hooks of the first and second upper core supporting members and the windings.

7. The transformer according to claim 6, wherein the second insulation members are spaced apart from the windings.

8. The transformer according to claim 3, wherein fastening members are provided to fasten the first upper core supporting member, the second upper core supporting member, the first lower core supporting member and the second lower core supporting member.

9. A method of manufacturing a transformer including annular iron cores composed of laminas of magnetic material and windings, wherein in order to assemble the cores and the windings while the cores are being kept upright, upper portions of the cores are supported by a first upper core supporting member disposed on first end surfaces of the upper portions of the cores, the first end surfaces being perpendicular to the faces of the laminas, and a second upper core supporting member disposed on second end surfaces of the upper portions of the cores, the second end surfaces being opposite and parallel to the first end surfaces of the cores;

lower portions of the cores are supported by a first lower core supporting member disposed on first end surfaces of the lower portions of the cores, the first end surfaces being perpendicular to the faces of the laminas, and a second lower core supporting member disposed on second end surfaces of the lower portions of the cores, the second end surfaces being opposite and parallel to the first end surfaces of the cores;

first insulation members are disposed on and between the first lower core supporting member and the second lower core supporting member;

the windings are disposed on the first insulation members;

second insulation members are disposed on top of the windings;

the first upper core supporting member and the second upper core supporting member are provided with hooks, the hooks of the first upper core supporting member extending toward the second upper core supporting member and the hooks of the second upper core supporting member extending toward the first upper core supporting member, and opposing pairs of the hooks of the first and second upper core supporting members being located respectively on the second insulation members;

bridging members are disposed on the opposing pairs of the hooks of the first and second upper core supporting members;

lower portions of the annular cores are open;

the cores are inserted through the windings from above while the cores and the windings are being kept upright;

the inserted cores are supported by the bridging members; and the lower portions of the cores are closed after insertion so as to restore the annular cores.

* * * * *